United States Patent [19]

Vidt

[11] Patent Number: 4,790,251

[45] Date of Patent: Dec. 13, 1988

[54] HIGH PRESSURE AND HIGH TEMPERATURE ASH DISCHARGE SYSTEM

[75] Inventor: Edward J. Vidt, Churchill Boro, Pa.

[73] Assignee: Westinghouse Electric Corp., Pittsburgh, Pa.

[21] Appl. No.: 95,381

[22] Filed: Sep. 8, 1987

[51] Int. Cl.[4] ..... F23J 1/00

[52] U.S. Cl. ..... 110/165 R; 110/259; 110/266; 414/218; 414/221

[58] Field of Search ..... 110/235, 245, 255, 259, 110/263, 266, 165 R, 166, 171; 414/209, 210, 213, 216, 217, 218, 221

[56] References Cited

U.S. PATENT DOCUMENTS

| | | | |
|---|---|---|---|
| 2,985,324 | 5/1961 | Balentine | 414/217 |
| 3,302,598 | 2/1967 | Godel | 110/165 R |
| 3,729,105 | 4/1973 | Huebler et al. | 414/218 |
| 4,401,402 | 8/1983 | Casperson | 414/221 X |
| 4,419,965 | 12/1983 | Garcia-Mallol et al. | 110/245 X |
| 4,700,636 | 10/1987 | Vogt et al. | 110/245 X |

OTHER PUBLICATIONS

"Hot Hot Gas Cleaning Improves the Economics of Electricity-from-Coal", G. P. Reed, Filtration and Separation, pp. 120-124, Mar./Apr. 1984.

*Primary Examiner*—Steven E. Warner
*Attorney, Agent, or Firm*—D. C. Abeles

[57] ABSTRACT

A system for discharging and cooling hot ash from a coal combustion unit, such as a coal combustor or an associated filter, where the hot ash at a temperature in excess of 700° C. and at superatmospheric pressure is charged to a jacketed, cooled screw conveyor and passed therethrough in contact with a countercurrent flow of a purge gas. The ash is cooled in the screw conveyor to a temperature of below 320° C. and dischaged to a collection hopper, under pressure, while the purge gas and gases evolved from the hot ash are returned to the combustion unit.

16 Claims, 1 Drawing Sheet

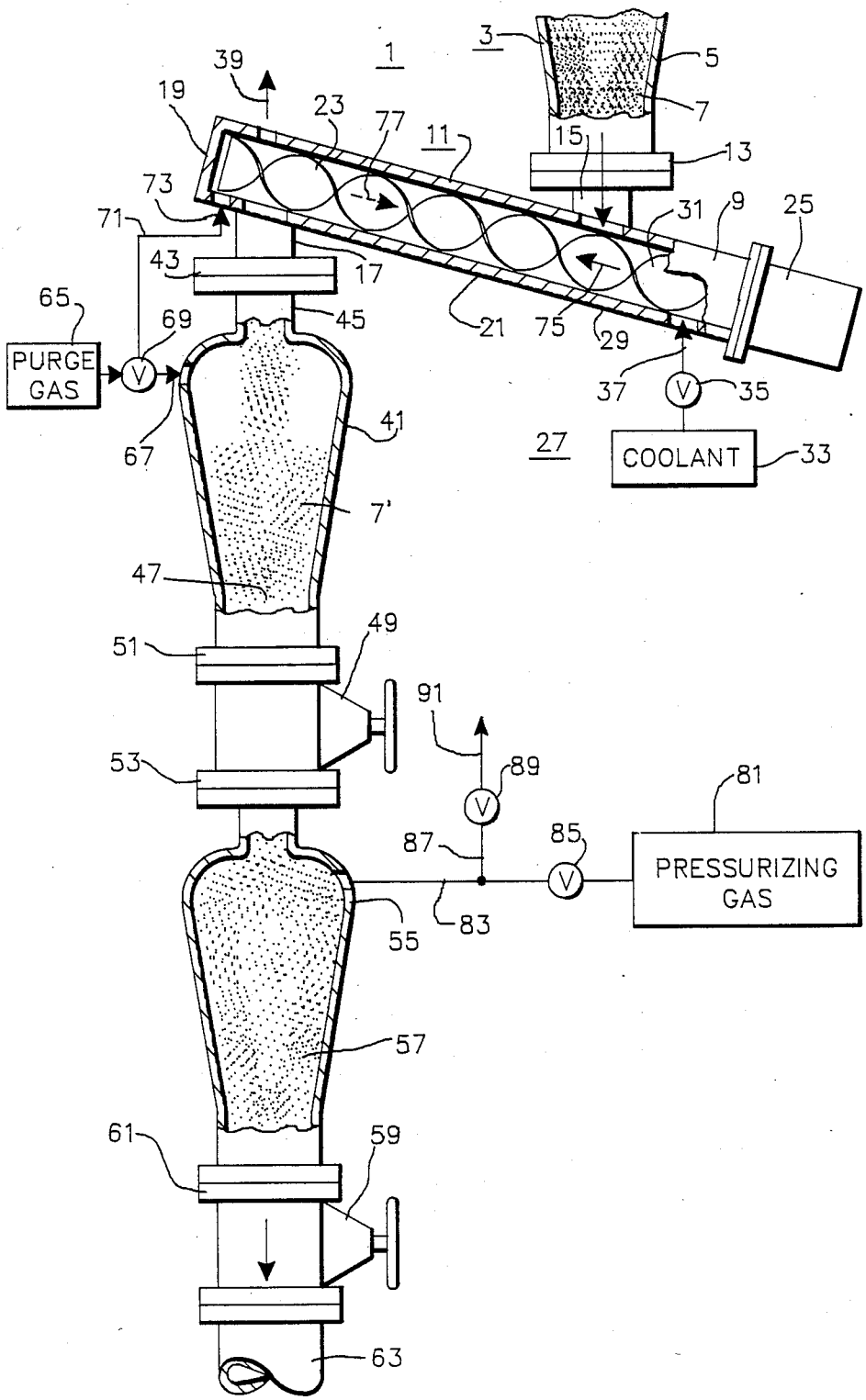
1
3
5
7
39
19
23
77
11
15
13
73
71
31
9
25
43
17
65
69
45
21
75
29
PURGE GAS
V
37
35
41
27
COOLANT
33
67
7'
47
49
51
91
53
89
81
87
85
PRESSURIZING GAS
55
83
57
61
59
63

HIGH PRESSURE AND HIGH TEMPERATURE ASH DISCHARGE SYSTEM

FIELD OF THE INVENTION

The present invention is a method and apparatus for discharging and cooling hot ash, under pressure, from a coal combustion unit, such as a coal combustor or an associated filter, which enables collection of the ash in a cool and dry particulate form.

BACKGROUND OF THE INVENTION

In recent years, pressurized fluidized bed combustion of coal has interested utilities worldwide for the generation of electric power in an environmentally acceptable manner. In such facilities, ambient temperature coal and limestone are fed by means of lockhoppers into a fluidized bed combustor operating at pressures of about 40 pounds per square inch to about 225 pounds per square inch or more, and at temperatures of between about 1600 to 1830° F. (about 870° to 1000° C.), in which 90 percent of the oxides of sulfur and nitrogen present in the coal are absorbed by the limestone. The gaseous combustion products are cleaned of larger particulates and then let down to atmospheric pressure through an expansion turbine which drives an air compressor and possibly an electric generator. Water boils inside tubes that are present in the combustor to provide steam that is also used to generate electric power.

This cycle has resulted in the construction of several prototype units in the United States, England, Sweden, and elsewhere. A plant in England, at Grimethorpe in South Yorkshire, has been in operation since 1982. A persistent problem with that operation has been the removal of hot, pressurized limestone-ash mixture from the combustor and from the associated gas cleaning or filtering equipment, all of which operate at combustor pressure and temperature conditions. Initially, the intent was to remove the limestone-ash mixture by means of batch water slurry tanks. The solids would be dumped into an agitated tank at system pressure and partially filled with water, where they would be quench cooled to below 250° F. (about 120° C.). The tank would then be isolated from the pressurized system, depressurized, and emptied of the solids and water slurry formed. Problems arose, however, with ash sticking, like concrete accretions in the tanks, erosion of the tanks, and water erupting up into the combusition system equipment.

Problems relative to filtering of the hot combustion gases also exist, as discussed in co-pending application Ser. No. 013,300, filed Feb. 10, 1987, in the names of Gordon Israelson, et al. (W.E. 53,607), and assigned to the assignee of the present invention, the contents of said application incorporated by reference herein. Hot solids collected in the filter system, which is pressurized and at high temperature, are collected in conical-shaped sections of a filter housing and discharged through a solids removal device such as a lockhopper or a screw conveyor, or the like.

It has been proposed to use high temperature alloy valves and refractory lined tanks to function as a lockhopper system to depressurize the discharged ash solids in a dry state, and then cool the ash solids for disposal. The valves, however, were expensive. Also, subsequent test work sponsored in the United States by EPRI showed that the high temperature fine solids exhibited a sticky property, so that the dry solids would not flow by gravity through the lockhopper system at temperatures above about 1200° F. (650° C.). The sticky property of the ash and limestone fine solids seemed to be related to the high temperature and possibly to the presence in the solids interstices of a gas containing water vapor with traces of sulfur dioxide and trioxide. Fly ash carried overhead from a pressurized fluidized bed combustor and collected on a filter has a tendency to clump up and stick together until cooled to a temperature well below 1600° F. (about 870° C.) at which the filter is operated. Cooling of the ash to below about 1000° F. (about 540° C.) removes the clumping tendency such that the ash will flow freely. The presence of carbon dioxide did not promote clumping, but it is conjectured that steam, sulfur dioxide and sulfur trioxide gases present may have an effect on the stickiness of the hot ash.

It is an object of the present invention to provide a dry discharge system for hot ash solids from a coal combustor or associated filter that avoids the problems of previous such discharge systems.

SUMMARY OF THE INVENTION

Hot ash from a coal combustion unit that operates at an elevated pressure in excess of 40 pounds per square inch and at a temperature in excess of 700° C., is discharged and cooled by charging the hot ash to a jacketed, cooled screw conveyor and passing the ash therethrough opposite to a flow of purge gas. The hot ash is moved through a housing of the screw conveyor by the screw and cooled indirectly to a temperature below about 320° C. while a purge gas is passed through the housing countercurrent to the flow of the hot ash being cooled. The countercurrent flow of purge gas, in addition to providing some cooling effect pickes up gases that are evolved from the ash and the mixed gases are discharged back into the combustion unit. The cooled and at least partially degassed ash is discharged from the jacketed, cooled screw conveyor into a hopper, such as a surge tank where it is collected under the conditions of pressure existing in the combustion unit and jacketed screw conveyor. Upon collection of a predetermined amount of cooled ash in the surge tank, the same is transferred to a second hopper and, after exposing the interior of the second hopper to atmospheric pressure, the cooled ash is discharged therefrom and removed.

The apparatus used to carry out the present method has a cooled screw conveyor that is directly in communication with a coupling of the combustion unit, having an outlet on the screw conveyor directly in communication with a hopper, the hopper being sealed at the other end thereof. A second hopper is connected to the first hopper which is exposable to atmospheric pressure. A gas inlet is provided either on the first hopper or the screw conveyor and with purge gas, from a source of gas, passed through the inlet into the screw conveyor for flow therethrough countercurrent to the flow of ash being cooled. Connection is provided between the screw conveyor and the combustion unit, such that the purge gas and gases evolved from the hot ash are discharged back into the combustion unit.

BRIEF DESCRIPTION OF THE DRAWING

The drawing is a schematic illustration of the present method and an embodiment of the apparatus of the present invention for carrying out the method.

DETAILED DESCRIPTION

According to the present invention, hot ash from a combustion unit, such as a coal combustor or an associated filter therefor, is cooled while under pressure corresponding to the pressure within the combustion unit and is then discharged to the atmosphere for collection in a cooled, dry state for removal and discarding. The hot ash, while being cooled, is passed countercurrent to a flow of purge gas which removes evolved gases therefrom and discharges them back into the coal combustion unit.

The hot ash that is cooled according to the present invention may comprise hot ash resulting from coal combustion and may contain limestone or other sulfur removal solid constituents that are used in the coal combustor to remove sulfur that is present in the coal consumed. The hot ash is formed under conditions of elevated pressure and high temperature in the coal combustor. Generally, the pressures within the coal combustion unit are in excess of 40 psig, and generally between about 100 to 175 psig, with normal operating conditions at a pressure of about 152 psig, and a maximum pressure of about 225 psig used. At such pressures, the combustion unit will operate at a temperature of greater than 700° C., and generally between about 750° to 900° C., with a normal operating condition of about 810° C., and a maximum temperature of about 1000° C. used. The hot ash, in addition to containing the residue of the coal combusted may also contain a solid sulfur removal constituent residue, such as the residue from limestone or dolomite, that is added to the combustor along with the coal so as to remove sulfur present in the coal and reduce or prevent pollution of the air due to exhaust from the combustion unit.

The hot ash from the combustion unit, at a temperature of above 700° C. and at superatmospheric pressure, is directly charged into a cooled screw conveyor that includes screw vanes within a closed housing, and the ash cooled during transport through the cooled screw conveyor. Such cooled screw conveying units are known and commercially available, one such pressurized fine solids conveyor being sold by the Denver Equipment Division of Joy Manufacturing Company which uses a water cooled jacket and screw. Such units had been used in pressurized service for cooling chemicals and in atmospheric pressure service to handle fluidized bed combustion solids discharge, but no use thereof is known in a purge gas, pressurized application.

The hot ash, directly discharged into the cooled screw conveyor, is moved through the cylindrical housing thereof by the screw vanes while a flow of inert or purge gas is passed through the housing countercurrent to the flow of the ash therethrough. The countercurrent passage of the purge gas through the conveyor assures that the gaseous products of combustion in the combustion unit, with a water vapor and sulfur dioxide and sulfur trioxide content, do not penetrate through the screw conveyor to the outlet thereof. Also, as the ash is being cooled, it is being purged or degassed of gaseous products of combustion so as to render the ash dry and in a non-sticking state, as well as cool enough to be handled in low-cost conventional carbon steel equipment in a lockhopper or other removal device.

The purge gas that is used as a countercurrent flow of gas in the cooled screw conveyor is a dry gas that is substantially free of sulfur dioxide and sulfur trioxide, having a water vapor content of below 0.6 percent by volume, and less than about 8 percent by volume of carbon dioxide. The water vapor content must be low so as to retard clumping of the ash in the screw conveyor, the 0.6 percent by volume of water vapor corresponding to an atmospheric dew point of about 34° F. (1.5° C.). Thus, air that is dried sufficiently so that its dew point is below 34° F. and then compressed to system pressure may be used. Also, inert gases such as nitrogen, helium and argon, may be used. In addition, gaseous exhaust from the combustion unit, when cooled under pressure to condense water, and with sulfur dioxide and sulfur trioxide removed, may then be expanded to atmospheric pressure and recompressed and used as a purge gas.

The flow rate of purge gas may vary dependent upon the combustion unit and screw conveyor system size and speed of operation but must be sufficient to provide a flow of inert gas countercurrent to the flow of ash while not significantly interfering with the flow of ash from the combustion unit to the inlet of the cooled screw conveyor, or flow of the ash through the conveyor. For example, with use of a 6 inch (15.24 cm) inner diameter inlet to the screw conveyor, a flow rate of less than about 1.25 pounds per minute purge gas would be used. This 1.25 lb/min flow would produce an upward superficial velocity of 0.5 ft/sec in the 6 inch opening, which velocity is sufficiently low as to minimize upward recirculation of 200 mesh or larger size ash particles. Lesser flow rates may be used provided the gases evolved from the ash are returned to the combustion unit, while the flow rate should be such that ash particles larger than about 200 mesh are not recycled.

The purge gas, after passage through the cooled screw conveyor is discharged into the combustion unit and combined with the other gases produced in the combustion unit for discharge therefrom, while the cooled ash is discharged, while at the pressure of the contents of the combustion unit and screw conveyor into a collection vessel such as a lockhopper.

The ash is cooled during passage through the cooled screw conveyor to a temperature of below about 320° C., so as to remove the sticky nature of the ash and also enable the use of low cost non-alloy steel collection equipment. The cooled ash is preferably discharged into a lockhopper that is directly connected to a second lockhopper through valving to permit ready discharge of batches of cooled ash from the system.

The drawing schematically illustrates the present method and apparatus for discharging hot ash from a pressurized coal combustion unit and cooling the same prior to exposure to the atmosphere. The apparatus 1 has a coal combustion unit 3, the interior of which is at superatmospheric pressure, which may be a fluidized bed combustor or filtering system therefore, that terminates as a conical section 5, into which hot ash 7, such as combusted coal ash, and limestone when present, falls by gravity and collects. The conical section 5 is directly attached, adjacent one end 9, to a jacketed screw conveyor 11, through a flanged coupling 13. The jacketed screw conveyor 11 has an inlet 15 to which the coupling 13 feeds, and an outlet 17 adjacent the other end 19 thereof, and is comprised of a tubular housing 21 containing a rotatable screw 23, the screw 23 rotated by a motor 25 from any suitable power source (not shown). Cooling means 27, such as a liquid coolant chamber 29 about the housing and also, preferably, hollow screw vanes 31 through which coolant may be passed, are fed with a coolant, such as water, from a source 33, through a valve 35, and line 37, into the jacketed screw conveyor 11, which coolant flows therethrough separate from ash contained therein to cool the ash by indirect cooling, which coolant is then discharged from the jacketed screw conveyor 11 through line 39. The jacketed screw conveyor is inclined at an acute angle from the inlet 15 to the outlet 19. Hot ash from the combustion unit 3 is charged to the jacketed screw conveyor 11 through inlet 15 and moved through the jacketed screw conveyor 11, while being cooled, and is discharged therefrom through outlet 17 into a sealed hopper 41, or surge tank, which is secured to the outlet 17 by flanged coupling 43. An inlet section 45 of the hopper 41 is in open communication with the discharge 17 of the jacketed screw conveyor 11, while an outlet section 47 thereof is sealed by a valve 49, such as a ball valve, through flanged coupling 51. Valve 49 is also connected, through flanged coupling 53, to a second hopper 55, the second hopper closed at its opposite or outlet end 57 by means of a valve 59, such as a ball valve, secured thereto through flanged coupling 61, which valve opens to the atmophere through conduit 63.

A source of purge gas 65 is provided which is connected to the hopper 41 through line 67 containing valve 69, while an alternate line 71 may be provided which communicates directly with the jacketed screw conveyor 11 through a gas inlet 73 adjacent end 19 thereof.

Hot ash 7 from the combustion unit 3 is fed through the inlet 15 into jacketed screw conveyor 11 and moves in a first direction from end 9 thereof towards the outlet 17 at the opposite end 19, as indicated by the solid arrow 75. A flow of purge gas from source 65 is charged to the jacketed screw conveyor 11, either through gas inlet 73, or to hopper 41 and through the discharge 17, and flows in a second direction, opposite the flow of the solids, as indicated by dashed arrow 77. The purge gas flowing through the jacketed screw conveyor 11 picks up gases in the interstices of and evolved from the hot ashes contained therein and the flow of mixed gases is directed back through the inlet 15 into the combustor unit 3.

A source 81 of pressurizing gas is provided for the second hopper 55, with gas under pressure passed through line 83 containing valve 85 into the second hopper. An offtake line 87, containing vent valve 89 is provided which leads to a gas disharge line 91. This system provides for pressurization and depressurization of the second hopper 55. The pressurizing gas may comprise any of the purge gases previously described.

Because the combustor unit 3 is open to the jacketed screw conveyor 11 through inlet 15 and the jacketed screw conveyor 11 is open to the hopper 41 through outlet 17, the pressure of the combustion unit is maintained through the jacketed screw conveyor 11 and hopper 41 to the valve 49, with cooled ash 7' collected in hopper 41 under such pressure. When a predetermined amount of cooled ash 7' is collected, valve 59 on the second hopper is closed and valve 49 opened such that the cooled ash is transferred to the second hopper 55. After closing of valve 49 following the transfer, the vent valve 89 is opened to gas discharge line 91 to depressurize the second hopper 55, and the valve 59 is then opened and the cooled ash is discharged to a collection bin or other removal means (not shown), at atmospheric pressure, through line 63. When the second hopper is empty, valve 59 is closed and the second hopper 55 is repressurized by closing vent valve 89 and charging pressurized gas from the source 81 through valve 85 and line 83 into the second hopper 55. When the pressure in second hopper 55 is comparable to that in the first hopper, the valve 49 can then be reopened.

In a system as described above, using a 6 inch inlet nozzle 15 to the screw conveyor 11, with operating conditions of 1600° F. (870° C.) and 150 p.s.i.g. for the downward flowing ash, a flow rate of purge gas of less than 1.25 lb/min, and preferably between 0.625 to 1.25 lb/min would be usable.

The present method and apparatus enable cooling and discharge of hot ash from a combustion unit and degassing of the same during such discharge. Purging of the ash by a countercurrent flow of purge gas will not only help to reduce the stickiness of the ash particles but, possibly more importantly, will prevent condensation of the sulfurous and sulfuric acids that sulfur dioxide and sulfur trioxide produce. This will also allow the use of mild steel instead of corrosion resistant steels in formation of the apparatus.

What is claimed is:

1. A method of discharging and cooling hot ash from a coal combustion unit operating at a pressure of greater than 40 pounds per square inch and a temperature in excess of 700° C., comprising:

charging said hot ash directly from the combustion unit into a screw conveyor having a rotatable screw contained in a housing, said screw conveyor having means thereon for cooling of the hot ash during passage through the housing thereof;

moving the hot ash through said housing, while at said pressure, by said screw, in a first direction while cooling said hot ash, at said pressure, to a temperature below 320° C.;

passing a purge gas through said housing in a second direction countercurrent to the movement of the hot ash therethrough;

discharging said purge gas, and gases evolved from said hot ash, from the housing into said combustion unit; and discharging said ash, while at said pressure and fter cooling, from said housing into a collection vessel.

2. The method of discharging and cooling hot ash from a coal combustion unit as defined in claim 1 wherein said hot ash contains a solid sulfur removal constituent residue.

3. The method of discharging and cooling hot ash from a coal combustion unit as defined in claim 2 wherein said solid sulfur removal constituent is selected from the group consisting of limestone and dolomite.

4. The method of discharging and cooling hot ash from a coal combustion unit as defined in claim 1 wherein said pressure is between about 100 to 175 psig.

5. The method of discharging and cooling hot ash from a coal combustion unit as defined in claim 2 wherein said temperature of said hot ash is between about 750° to 900° C.

6. The method of discharging and cooling hot ash from a coal combustion unit as defined in claim 5 wherein said purge gas is air having a water vapor content of less than about 0.6 percent by volume.

7. The method of discharging and cooling hot ash from a coal combustion unit as defined in claim 5 wherein said purge gas is an inert gas selected from the group consisting of nitrogen, argon and helium.

8. The method of discharging and cooling hot ash from a coal combustion unit as defined in claim 7 wherein said purge gas is nitrogen.

9. A method of discharging and cooling hot ash containing a solid sulfur removal constituent residue from a coal combustion unit operating at a pressure of between about 100 to 175 pounds per square inch and a temperature of between about 750° to 900° C. comprising:

charging said hot ash directly from the combustion unit into a screw conveyor having a rotatable screw contained in a housing, said screw conveyor having means thereon for cooling of the hot ash during passage through the housing thereof;

moving the hot ash through said housing, while at said pressure, by said screw, in a first direction while cooling said hot ash, at said pressure, to a temperature below 320° C.;

passing a purge gas through said housing in a second direction countercurrent to the movement of the hot ash therethrough;

discharging said purge gas, and gases evolved from said hot ash, from the housing into said combustion unit; and discharging said ash, while at said pressure and after cooling, from said housing into a collection vessel.

10. An apparatus for discharging of hot ash from a coal combustion unit, the interior of said coal combustion unit being at superatmospheric pressure and terminating at a coupling, comprising:

a cooled screw conveyor, having an inlet adjacent one end thereof connected to said copling, and an outlet adjacent the other end thereof such that hot ash is charged to said screw conveyor and flows therethrough;

a hopper, having an inlet section and an outlet section;

means for securing the inlet section of said hopper to the outlet of said cooled screw conveyor and in open communication therewith;

means for alternatively sealing and unsealing the outlet section of said hopper; and means for passing a purge gas through the cooled screw conveyor, adjacent the outlet thereof, for flow therethrough countercurrent to the flow of hot ash; whereby the purge gas, and gases from the interstices of and evolved from said hot ash in the cooled screw conveyor, are discharged into said combustion unit.

11. An apparatus for discharging of hot ash from a coal combustion unit as defined in claim 10 wherein a second hopper having an outlet is connected to the outlet of said hopper and means provided for alternatively sealing and unsealing the outlet of said second hopper.

12. An apparatus for discharging of hot ash from a coal combustion unit as defined in claim 10 wherein said means for passing a purge gas through the cooled screw conveyor comprises a source of purge gas connected to said hopper.

13. An apparatus for discharging of hot ash from a coal combustion unit as defined in claim 10 wherein said means for passing a purge gas through the cooled screw conveyor comprises a source of purge gas and a gas inlet on said cooled screw conveyor adjacent the other end thereof in communication therewith.

14. An apparatus for discharging of hot ash from a coal combustion unit, the interior of said coal combustion unit being at superatmospheric pressure and terminating at a coupling, comprising:

a cooled screw conveyor, having an inlet adjacent one end thereof connected to said coupling, and an outlet adjacent the other end thereof such that hot ash is charged to said screw conveyor and flows therethrough;

a first hopper, having an inlet section and an outlet section;

means for securing the inlet section of said first hopper to the outlet of said cooled screw conveyor and in open communication therewith;

first means for alternatively sealing and unsealing the outlet section of said first hopper;

a second hopper, having an outlet, secured to said first means for alternatively sealing and unsealing the outlet section of said first hopper;

second means for alternatively sealing and unsealing the outlet section of said second hopper; and means for passing a purge gas through the cooled screw conveyor, adjacent the outlet thereof, for flow therethrough countercurrent to the flow of hot ash; whereby the purge gas, and gases from the interstices of and evolved from said hot ash in the cooled screw conveyor, are discharged into said combustion unit.

15. An apparatus for discharging of hot ash from a coal combustion unit as defined in claim 15 wherein said means for passing a purge gas through the cooled screw conveyor comprises a source of purge gas connected to said first hopper.

16. An apparatus for discharging of hot ash from a coal combustion unit as defined in claim 14 wherein said means for passing a purge gas through the cooled screw conveyor comprises a source of purge gas and a gas inlet on said cooled screw conveyor adjacent the other end therof in communication therewith.

* * * * *